US006626098B1

(12) United States Patent
Kanamori

(10) Patent No.: US 6,626,098 B1
(45) **Date of Patent: *Sep. 30, 2003**

(54) MASTER MAKING DEVICE FOR A STENCIL PRINTER

(75) Inventor: Yoshio Kanamori, Zaou-machi (JP)

(73) Assignee: Tohoku Ricoh Co., Ltd., Shibata-gun (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 610 days.

(21) Appl. No.: 09/110,128

(22) Filed: Jul. 6, 1998

(30) Foreign Application Priority Data

Jul. 8, 1997 (JP) ..... 9-182258
Apr. 24, 1998 (JP) ..... 10-115054

(51) Int. Cl.[7] ..... B41C 1/055; B41C 1/14; B41J 2/32

(52) U.S. Cl. ..... 101/128.4; 400/120.13; 347/193

(58) Field of Search ..... 101/128.21, 128.4; 400/120.13, 120.14, 120.16, 120.17; 347/193, 194, 197, 198

(56) References Cited

U.S. PATENT DOCUMENTS 5,415,090 A * 5/1995 Natori et al. ..... 101/128.21
5,417,156 A * 5/1995 Tateishi et al. ..... 101/128.21
5,422,660 A * 6/1995 Oikawa ..... 347/198

FOREIGN PATENT DOCUMENTS

| | | | |
|---|---|---|---|
| JP | 172669 | * | 7/1988 |
| JP | 64-7589 | | 2/1989 |
| JP | 175056 | * | 7/1991 |
| JP | 6-328653 | | 11/1994 |
| JP | 7-156520 | | 6/1995 |
| JP | 9-71030 | | 3/1997 |

OTHER PUBLICATIONS

Translation of Iwakawa et al. (JP 3–175,056).*

* cited by examiner

*Primary Examiner*—Stephen R. Funk
(74) *Attorney, Agent, or Firm*—Oblon, Spivak, McClelland, Maier & Neustadt, P.C.

(57) ABSTRACT

A master making device of the present invention includes a thermal head having a plurality of heating elements arranged in an array in the main scanning direction. A platen roller forms a nip between it and the thermal head for pressing a stencil. The platen roller is rotatable for moving the stencil in the subscanning direction perpendicular to the main scanning direction. The position of the array of heating elements in the subscanning direction is deviated, within the nip, from the center of the platen roller to the downstream side in the subscanning direction to thereby reduce the length of the perforated portion of the stencil to be moved in the nip. The device is capable of providing a master with an accurate length without regard to the kind of the stencil and insuring stable conveyance of the stencil.

7 Claims, 7 Drawing Sheets

Fig. 9

| DEVIATION L OF HEATING ELEMENTS | IMAGE DIMENSION REPRODUCIBILITY | CREASING | LOCAL IMAGE OMISSION |
|---|---|---|---|
| 0mm | × | × | ◎ |
| 0.2mm | ○ | ○ | ◎ |
| 0.4mm | ○ | ○ | ◎ |
| 0.6mm | ○ | ○ | ○ |
| 0.8mm | ◎ | ◎ | ○ |
| 1.0mm | ◎ | ◎ | × |
| 1.2mm | ◎ | ◎ | × |

DESIRABLE RANGE

MASTER MAKING DEVICE FOR A STENCIL PRINTER

BACKGROUND OF THE INVENTION

The present invention relates to a master making device for a printer and, more particularly, to a master making device for a stencil printer and including a thermal head and a platen roller.

A digital thermal stencil printer is extensively used because of its simple printing system. This kind of printer includes a thermal head having a plurality of fine heating elements arranged in an array in the main scanning direction. While the head is pressed against a platen roller via a thermosensitive stencil, the heating elements are selectively energized by pulses. At the same time, the stencil is conveyed by the platen roller in the subscanning direction perpendicular to the main scanning direction. As a result, the stencil is perforated, or cut, by heat in accordance with image data. The perforated part of the stencil, i.e., a master is automatically conveyed to and wrapped around a porous cylindrical drum. Subsequently, a press roller or similar pressing means continuously presses a paper or similar recording medium against the master. Consequently, ink is transferred from the drum to the paper via the perforations of the master, forming an image on the paper.

A master making device is included in the printer in order to make the above master. Usually, a nip at least several times as great as the dimension of the heating element array, as measured in the subscanning direction, is formed between the thermal head and the platen roller, taking account of the scatters of the platen roller and other related parts in the subscanning direction and the scatter of the position of the heating element array as well as other scatters. The center of the heating element array in the subscanning direction is coincident with the center of the platen roller in the nip. Let this type of master making device be referred to as a first type of master making device.

Japanese Patent Laid-Open Publication No. 6-328653, for example, proposes a master making device in which the heating element array is deviated to the upstream side from the center of the platen roller in the subscanning direction within the nip. The above document teaches that with this configuration it is possible to set a required nipping length after perforation and therefor to produce a master free from creases ascribable to shrinkage even when the master is implemented by a stencil substantially consisting only of a thermoplastic resin film. This type of master making device will be referred to as a second type of master making device hereinafter.

A stencil for use in a thermal stencil printer has a laminate structure made up of an extremely thin film of polyester or similar thermoplastic resin and a porous base or support permeable to ink. The base is formed of synthetic fibers, Japanese paper or a combination thereof. There has recently been developed a stencil including a base entirely formed of fine synthetic fibers or formed of a mixture of natural fibers and fine synthetic fibers in order to improve image quality. This kind of master, or synthetic fiber base master as referred to hereinafter for distinction, is not as thin as the stencil substantially consisting only of a thermoplastic resin film (about 1 $\mu$m to 8 $\mu$m thick), but thinner than the traditional stencil (about 40 $\mu$m to 50 $\mu$m thick). Specifically, the synthetic fiber base master is about 10 $\mu$m to 30 $\mu$m thick and lower in rigidity or elasticity than the stencil whose base is formed of natural fibers.

Assume that the stencil whose base is formed of natural fibers has a coefficient of friction $\mu$ of 1, as measured on the ba se surface of the stencil. Then, the base surface of the synthetic fiber base master has a coefficient of friction $\mu$ of about 0.8 lower than 1. On the other hand, the smoothness of the film surface of the stencil depends on the diameter of fibers constituting the base. For example, as for the stencil whose base is formed of natural fibers, the fibers have a greater diameter than the synthetic fibers of the synthetic fiber base master and render the base surface irregular.

Because the film is adhered to such an irregular base surface, the smoothness of the film surface is lower than that of the film surface of the synthetic fiber base master whose fibers have a small and uniform diameter. The synthetic fiber base stencil is therefore higher in the smoothness of the film surface than the stencil whose base is formed of natural fibers.

The first and second types of master making devices described above each has the following problem left unsolved. Assume that the first type of master making device perforates the synthetic fiber base stencil thinner, less elastic and softer than the traditional stencil with the head, and conveys the perforated stencil or master with the platen roller. Then, the conveying force of the platen roller decreases because the surface of the base of the master being pressed by the platen roller has its coefficient of friction reduced and because the film surface of the master has its smoothness increased. As a result, the film of the stencil sticks to the surfaces of the heating elements of the head due to heat stored in the platen roller due to a master representative of a solid image having a substantial area. This causes the platen roller and master to slip on each other frequently and thereby reduces the master making length. Consequently, the conveyance of the master is deteriorated. This is also true with the second type master making device and presumably occurs, in greater or less degree, when use is made of a stencil including a film.

Technologies relating to the present invention are also disclosed in, e.g., Japanese Patent Laid-Open Publication Nos. 7-156520, 9-71030 and 57-157771 (corresponding to Japanese Patent Publication No. 64-7589).

SUMMARY OF THE INVENTION

It is therefore an object of the present invention to provide a master making device for a printer capable of providing a master with an accurate length without regard to the kind of a stencil and insuring stable conveyance of the master.

A master making device of the present invention includes a thermal head having a plurality of heating elements arranged in an array in the main scanning direction. A platen roller forms a nip between it and the thermal head for pressing a stencil. The platen roller is rotatable for moving the stencil in the subscanning direction perpendicular to the main scanning direction. The position of the array of heating elements in the subscanning direction is deviated, within the nip, from the center of the platen roller to the downstream side in the subscanning direction to thereby reduce the length of the perforated portion of the stencil to be moved in the nip.

BRIEF DESCRIPTION OF THE DRAWINGS

The above and other objects, features and advantages of the present invention will become apparent from the following detailed description taken with the accompanying drawings in which:

FIG. 9 is a table listing the results of experiments conducted to estimate image dimension reproducibility, crease and local image omission with respect to various positions of the heating element array relative to the platen roller in an intended direction of stencil feed;

In the figures, identical reference numerals denote identical structural elements.

DESCRIPTION OF THE PREFERRED EMBODIMENT

To better understand the present invention, brief reference will be made to a conventional master making device. Assume that the first type of master making device stated earlier perforates the synthetic fiber base stencil thinner, less elastic and softer than the traditional stencil with a thermal head, and conveys the perforated stencil or master with a platen roller. Then, the conveying force of the platen roller decreases because the surface of the base of the master being pressed by the platen roller has its coefficient of friction reduced and because the film surface of the master has its smoothness increased. This results in sticking as discussed earlier. Sticking causes the platen roller and master to slip on each other frequently and thereby reduces the master making length. Consequently, the conveyance of the master is deteriorated. This problem will be discussed more specifically with reference to FIG. 1.

Figure 1:
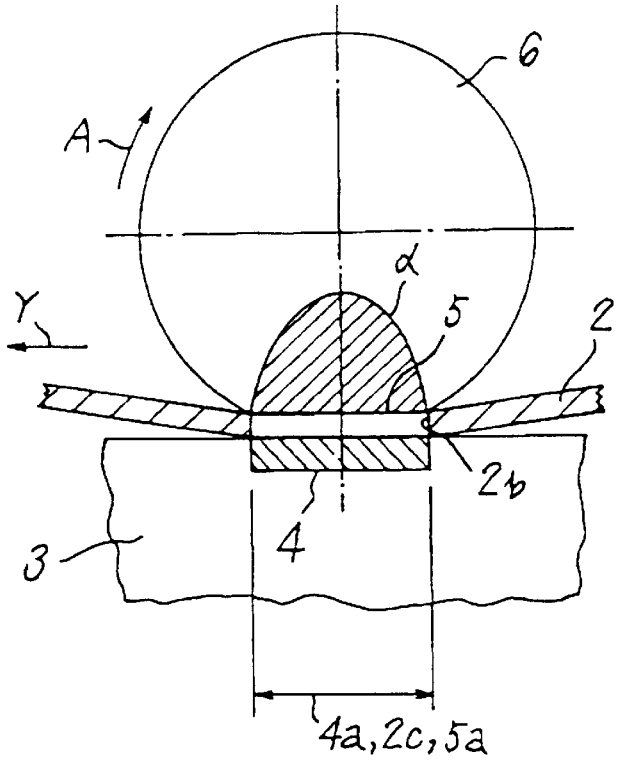
FIG. 1 PRIOR ART
FIG. 1 is a partly sectional front view demonstrating the influence of the position of the heating element array of a thermal head and the distribution of heat stored in a platen roller due to perforation on the length of a stencil to be conveyed in an ideal nip.

FIG. 1 shows an essential part of the first type of master making device and a relation between the ideal nip width and the distribution of heat stored in a platen roller 6. As shown, a thermal head 3 has a plurality of fine heating elements 4 arranged in an array in the main scanning direction (perpendicularly to the sheet surface of FIG. 1). The thermal head 3 and platen 6 form a nip 5 therebetween for pressing a synthetic fiber base stencil 2. The platen roller 6 is rotated clockwise, as viewed in FIG. 1 and as indicated by an arrow A, conveying the stencil 2 in a direction indicated by an arrow Y. The head 3 perforates the stencil 2 being so conveyed by the platen roller 6. Theoretically, so long as the width 5*a* of the nip 5 is the same as the width 4*a* of the heating element 4, as measured in the direction Y, the device can melt the stencil 2 with heat so as to form a perforation 2*b*. There are also shown in FIG. 1 the width 2*c* of the perforation in the direction Y, and the distribution of heat α (peak-like portion indicated by hatching) stored in the platen roller 6 at the nip 5 in a short period of time during which the perforation 2*b* is formed by the array of heating elements 4.

In practice, however, the nip width 5*a* must be increased in order to surely form the perforation 2*b* in consideration of various kinds of scatters including the scatters in the accuracy and mounting position of the platen roller 6 and other parts, and the scatter in the mounting position of the roller 6 relative to the array of heating elements 4. The nip width 5*a* on the platen roller 6 is determined by the diameter of the platen roller 6, the thickness and rubber hardness of a surface elastic layer covering the roller 6, and a pressure acting between the surface elastic layer and the thermal head 3. Such factors are adequately designed and set in order to provide the nip width 5*a* suitable for a desired purpose and a desired application.

Figure 2:
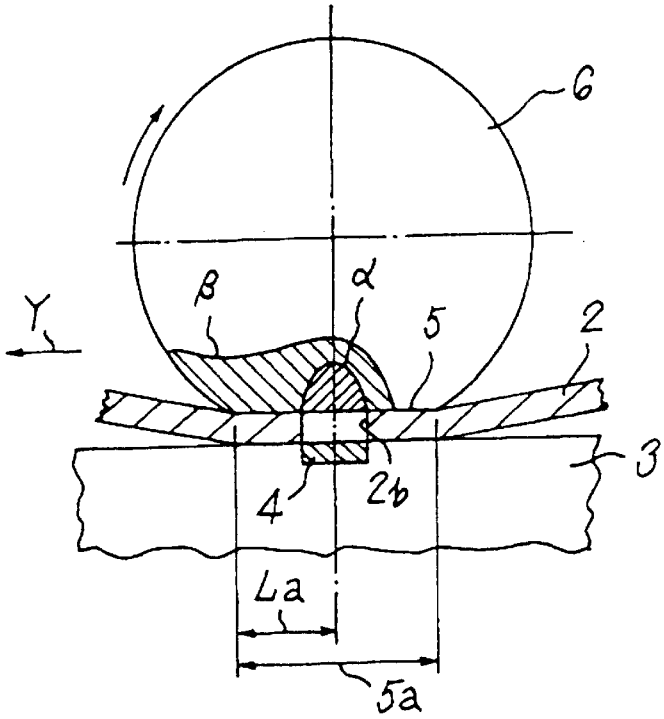
FIG. 2 PRIOR ART
FIG. 2 is a view similar to FIG. 1, demonstrating the influence of the position of the heating element array of a thermal head and the distribution of heat stored in a platen roller due to perforation and the previous heat distribution on the length of a stencil to be conveyed in the nip of a conventional master making device.

FIG. 2 shows a relation between the actual nip width 5*a* and the heat distribution of the platen roller 6 presumably occurring in the first type of master making device. In FIG. 2, a hill-like hatched area β is representative of the distribution of heat previously stored in the portion of the platen roller 6 adjoining the nip 5 in a short period of time before the heating elements 4 form the current perforation 2*b*. It should be noted that the height of the heat distribution α and that of the heat distribution β each indicates the qualitative inclination of heat storage in the respective distribution. That is, the condition shown in FIG. 2 does not indicate that the height of the temperature distribution β is higher than the height of the temperature distribution α. As FIG. 2 indicates, when the length La of the perforated portion of the synthetic fiber base master 2 conveyed in the nip 5 is great, heat ascribable to the combination of the distributions β and α acts on heat storage ascribable to the heating elements 4 synergistically. As a result, the film surface of the stencil 2 sticks to a protection film provided on the peripheral portion of the head 3 including the heating elements 4. This obstructs the stable conveyance of the stencil 2.

Figure 3:
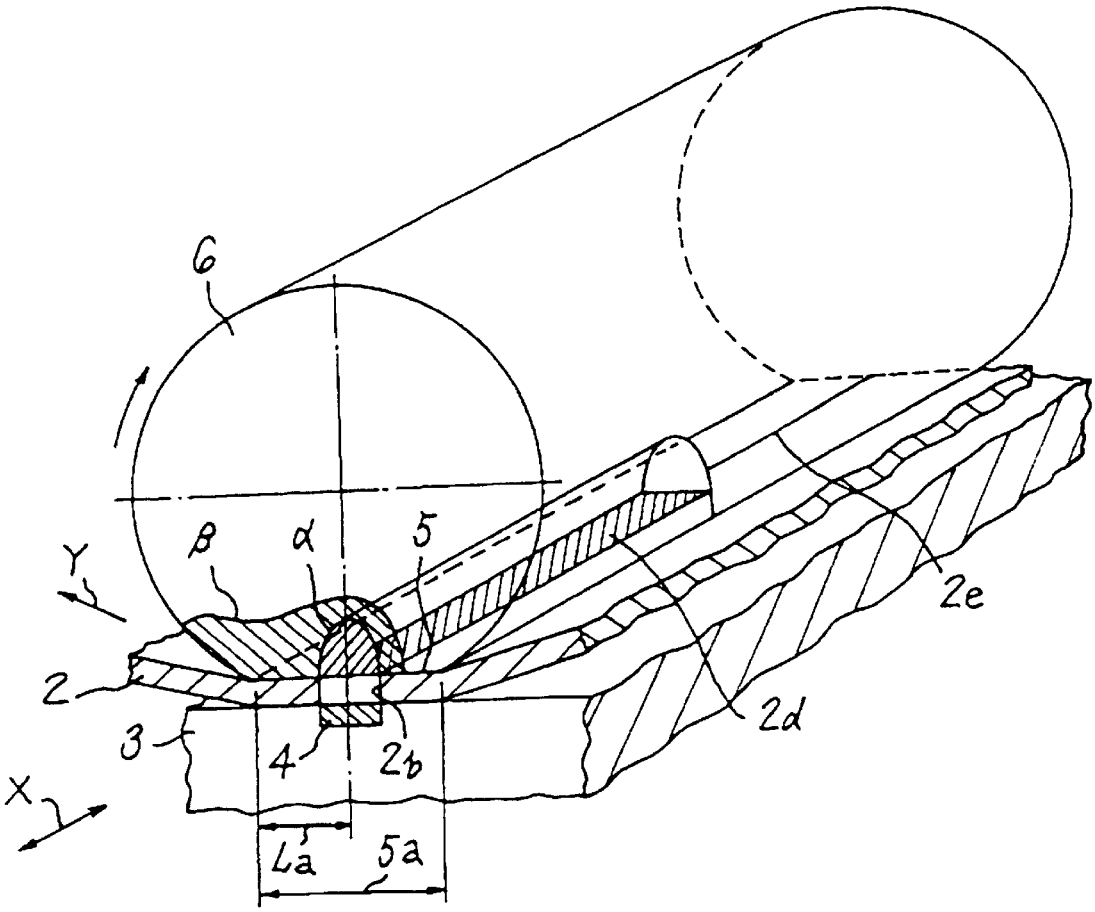
FIG. 3 PRIOR ART
FIG. 3 is a partly sectional perspective view demonstrating the influence of the position of the heating element array of a thermal head, the distribution of heat stored in a platen roller due to perforation and the previous heat distribution, a perforated portion and a non-perforated portion on the length of a stencil to be conveyed in the nip of a conventional master making device.

Further, as shown in FIG. 3, assume that the perforated portion of the synthetic fiber base stencil 2 representative of an image one half of which is solid is conveyed over a great length La in the nip 5. Then, the stencil 2 has each of its perforated portion 2*d* and non-perforated portion 2*e* conveyed by a particular force at the heating elements 4 arranged in the main scanning direction X. Consequently, creasing of the stencil 2 becomes conspicuous due to the low rigidity of the stencil 2 and thereby noticeably deteriorates conveyance. In addition, when the perforated portion 2*d* extends over the entire width of the stencil 2, the conveying force and therefore image dimension reproducibility is degraded.

Moreover, assume that the synthetic fiber base stencil 2 is paid out from a roll. Then, any crease of the stencil 2 continues to the end of the stencil 2 and causes it to be conveyed askew or to jam the conveyance path. To smooth down the stencil 2, it is necessary to reset the roll or to cut the stencil, resulting in extra operation and the waste of the stencil.

The second type of master making apparatus also has the above problems, as stated earlier.

Figure 4:
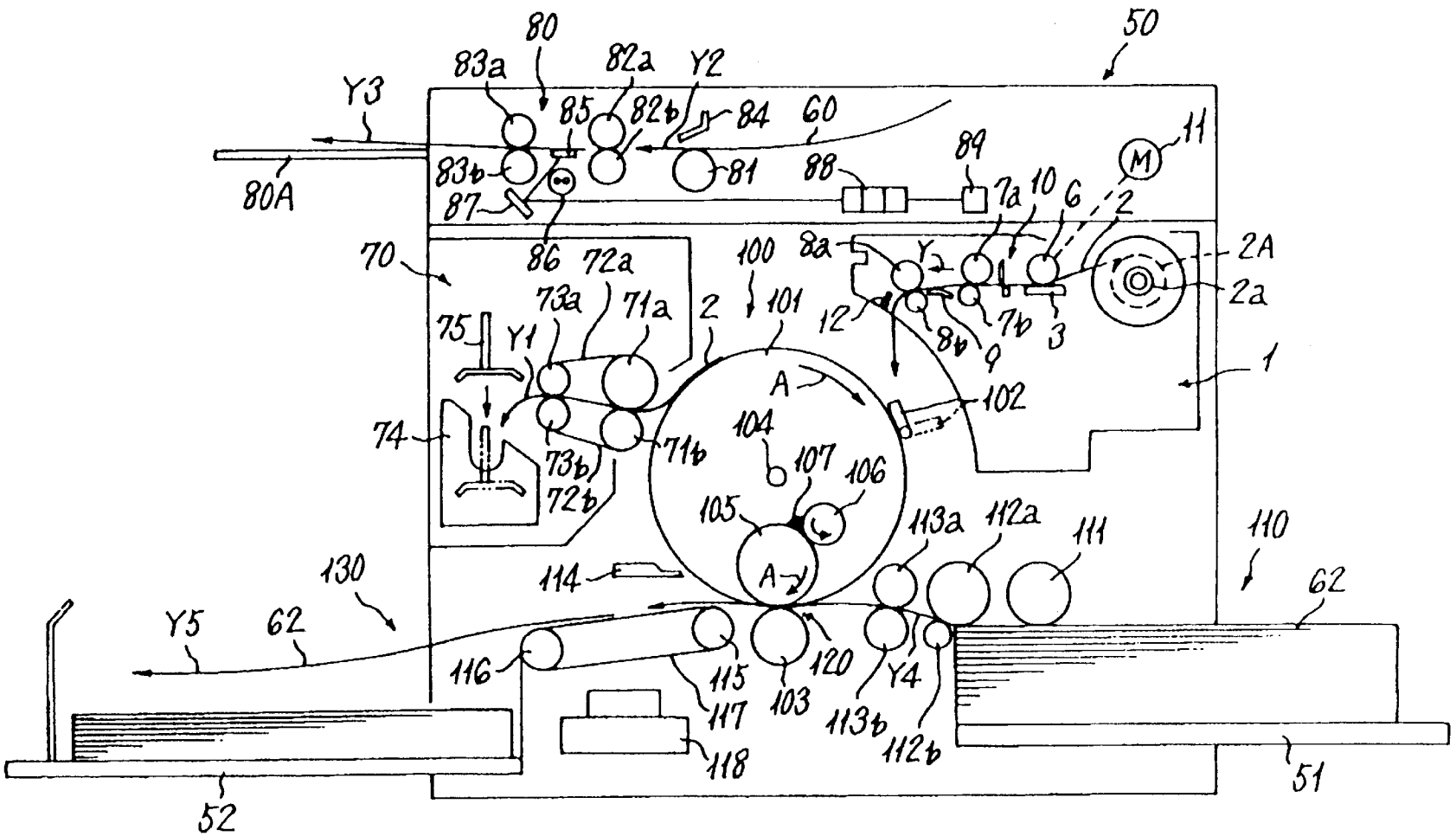
FIG. 4 is a front view showing a stencil printer to which the present invention is applied.

Referring to FIG. 4, a stencil printer to which the present invention is applicable will be described. As for structural elements provided in pairs, but not needing distinction, only one of them will be described for the sake of simplicity. As shown, the printer includes a casing or body 50. A document scanning device (scanner hereinafter) 80 is arranged in the upper portion of the casing 50. A master making device 1 is positioned below the scanner 80. A print drum device 100 is located at the left of the master making device 1 and includes a porous print drum 101. A master discharging device 70 is located at the left of the print drum device 100. A paper discharging device 130 is arranged in the lower left portion of the casing 50. The printer is implemented as a digital thermal stencil printer having the digital thermal master making device 1 mounted on the casing 50.

In operation, a desired document 60 is laid on a table, not shown, mounted on the top of the scanner 80. As soon as a perforation start key, not shown, is pressed, a master discharging step is executed. Specifically, at this stage of operation, a master 2 used in the last printing operation is left on the outer periphery of the print drum 101.

While the print drum 101 is rotated counterclockwise, the trailing edge of the used master 2 remaining on the drum 101 approaches a pair of peeler rollers 71*a* and 71*b* included in the master discharging device 70. Then, the peeler roller 71*b* rotating together with the peeler roller 71*a* picks up the trailing edge of the master 2. A pair of conveyor belts 72*a* and 72*b* are respectively passed over the peeler rollers 71*a* and 71*b* and rollers 73*a* and 73*b* located at the left of the rollers 71*a* and 71*b*. The conveyor belts 72*a* and 72*b* convey the trailing edge of the master 2 toward a waste master box 74. in a direction indicated by an arrow Y1. As a result, the master 2 is sequentially peeled off from the print drum 101 and discharged into the waste master box 74. At this instant, the print drum 101 is still rotating counterclockwise. A compression plate 75 compresses the master 2 fully discharged into the box 74.

In parallel with the above master discharging step, the scanner 80 scans or reads the document 60. Specifically, the document 60 is conveyed from the table by a pick-up roller 81, a pair of front conveyor rollers 82*a* and 82*b* and a pair of rear conveyor rollers 83*a* and 83*b* in consecutive directions indicated by arrows Y2 and Y3, while being optically read. When a plurality of documents 60 are stacked on the tray, the bottom document 60 will be fed first by being separated from the overlying documents 60 by a blade 84. While the document 60 is conveyed along a glass platen 85, a fluorescent lamp 86 illuminates the document 60. The resulting imagewise reflection from the document 60 is reflected by a mirror 87 and then incident to a CCD (Charge Coupled Device) image sensor 89 via a lens 88. The document 60 so read by the scanner 80 is driven out to a tray 80A. The image sensor 89 transforms the incident light to a corresponding electric signal and feeds the electric signal to an analog-to-digital (AD) conversion board, not shown, included in the casing 50. The electric signal is converted to a digital image signal by the AD conversion board.

A master making and feeding step is executed on the basis of the above digital image signal or image data in parallel with the document reading step. Specifically, a new stencil 2 is implemented as a roll 2A wound round a core 2*a* and set in a preselected position of the master making device 1. The platen roller 6 pressed against the thermal head 3 via the stencil 2 paid out from the roll 2A and a pair of tension rollers 7*a* and 7*b* convey the stencil 2 to the downstream side in the direction Y. The fine heating elements 4 arranged on the head 3 in an array in the main scanning direction, as shown in FIG. 2, are selectively energized in accordance with the digital image signal received from the AD conversion board. The energized heating elements 4 perforate the portions of the thermoplastic resin film of the stencil 2 contacting them with heat. As a result, image data representative of the image of the document 60 are written to the stencil 2 in the form of a perforation pattern.

As shown in FIG. 2, the head 3 and platen roller 6 are positioned relative to each other in the direction of stencil conveyance Y such that the center of the array of the heating elements 4 and that of the platen roller 6 are coincident with each other.

A drive motor 11 is drivably connected to the platen roller 6 via a timing belt and gears or similar rotation transmitting members not shown. The drive motor 11 may be implemented by a stepping motor by way of example. In this configuration, the rotation of the motor 11 is transmitted to a pair of turn rollers 8*a* and 8*b* via the tension rollers 7*a* and 7*b* and an electromagnetic clutch not shown.

The leading edge of the perforated stencil, or master, 2 is conveyed by the turn rollers 8*a* and 8*b* toward the outer periphery of the print drum 101 while being guided by a guide 9. A guide 12 steers the leading edge of the master 2 downward and thereby causes it to hang down toward a master damper 102. At this instant, the master damper 102 is held open at a master feed position, as indicated by a phantom line in FIG. 4. The used master 2 has already been removed from the print drum 101 by the previously stated procedure.

As soon as the master damper 102 clamps the leading edge of the master 2 at a preselected timing, the print drum 101 is caused to rotate clockwise (arrow A) so as to wrap the master 2 therearound. The trailing edge portion of the master 2 is cut at a preselected length by a cutter 10.

After the master 2 has been fully wrapped around the print drum 101, a master printing step is executed. First, a pick-up roller 111 and a pair of separator rollers 112*a* and 112*b* feed a single paper from the top of a paper stack 62 loaded on a paper tray 51 toward a pair of registration rollers 113*a* and 113*b* in a direction indicated by an arrow Y4. The registration rollers 113*a* and 113*b* drive the paper 62 toward a pressing device 120 at a preselected timing synchronous with the rotation of the print drum 101. When the paper 62 is brought to a gap between the print drum 101 and a press roller 103 included in the pressing device 120, the press roller 103 positioned below the print drum 101 is raised into contact with outer periphery of the drum 101 with the intermediary of the master 2 wrapped around the print drum 101. As a result, ink oozes out via the porous portion, not shown, of the print drum 101 and the perforation pattern, not shown, of the master 2. The ink is transferred from the print drum 101 to the paper 62, forming an image on the paper 62.

Specifically, in the print drum 101, an ink well 107 is formed between an ink roller 105 and a doctor roller 106. Ink is fed to the ink well 107 via an ink feed pipe 104. The ink roller is held in contact with the inner periphery of the print drum and rotated in the same direction as and in synchronism with the print drum 101. Consequently, the ink is fed from the ink well 107 to the inner periphery of the print drum 101 by the ink roller 105.

A peeler 114 is included in the paper discharging device 130 and peels off the paper 62 carrying the image thereon from the print drum 101. A conveyor belt 117 is passed over an inlet roller 115 and an outlet roller 116 and rotated counterclockwise. The paper 62 removed from the print drum 101 is conveyed by the conveyor belt 117 toward the paper discharging device 130 in the direction Y5 while being sucked by a suction fan 118. Finally, the paper 62 is driven out onto a tray 52 as a so-called trial printing.

If the trial printing is acceptable, the number of printings to be output is input on numeral keys, not shown, and then a print start key, not shown, is pressed. In response, the paper feeding step, printing step and paper discharging step are repeated a number of times corresponding to the desired number of printings in the same manner as in the above trial printing procedure. This is the end of the printing operation.

A preferred embodiment of the master making device in accordance with the present invention will be described with reference to FIGS. 5, 6, 7, 8A and 8B. A master making device, labeled 1A, to be described is identical with the master making device 1 shown in FIG. 4 except for the following. In FIG. 4, the center of the array of the heating elements 4 and that of the platen roller 6 are coincident with each other. By contrast, in the illustrative embodiment, the center of the array of the heating elements 4 in the direction of stencil conveyance Y is deviated by a distance (dimension) of L from the center of the platen roller 6 to the downstream side within the nip in the direction Y. This alternative positional relation between the head 3 and the platen roller 6 successfully reduces the length of the perforated part of the master 2 moved within the nip 5 (or conveying time). Tension roller drive means for driving the tension rollers 7*a* and 7*b* is connected to the drive motor 11 via a rotation transmission mechanism. A torque limiter 18 intervenes between the tension roller 7*a* and the rotation transmission mechanism, so that the tension roller 7*a* is rotated at a higher peripheral speed than the platen roller 6.

Arrangements around the stencil 2, head 3, platen roller 6, tension rollers 7*a* and 7*b* and turn rollers 8*a* and 8*b* will be described hereinafter together with the above rotation transmission mechanism and the configuration of the torque limiter 18.

Figure 7:
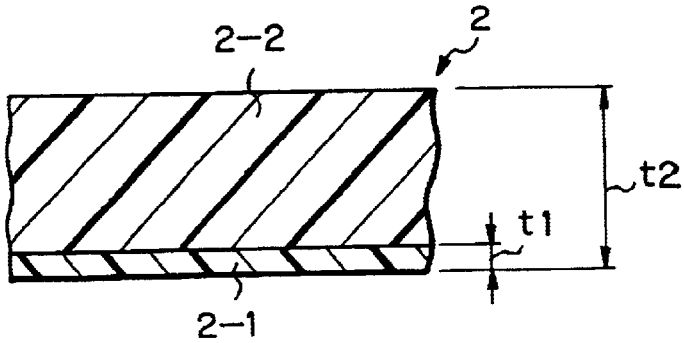
FIG. 7 is a sectional front view of a synthetic fiber base master applied to the illustrative embodiment.

FIG. 7 shows the configuration of the stencil 2 applicable to the illustrative embodiment. As shown, the stencil 2 is implemented as a synthetic fiber base stencil consisting of a base (porous support) 2-2 and a thermoplastic resin film 2-1 adhered to each other. The base 2-2 is entirely formed of fine PET (polyethylene terephthalate) fibers. The thermoplastic resin film 2-1 is also formed of PET and has a thickness t1 of 1.5 $\mu$m. The stencil 2 has a total thickness t2 ranging from 25 $\mu$m to 30 $\mu$m. Let such a stencil 2 be referred to as a synthetic fiber base stencil 2 in distinction from the conventional stencil 2. The PET fibers of the base 2-2 have an identical diameter of 4 $\mu$m to 14 $\mu$m (0.1 denier to 1.1 denier in terms of linear density); the fibers are woven together vertically and horizontally.

Bending rigidity, which is one of typical characteristics, was measured with each of the conventional stencil 2 and synthetic fiber base stencil 2 by use of an L & W rigidity tester available from Lorentzen & Wettre. With the L & W rigidity tester, it is possible to measure the rigidity of, e.g., the stencil 2 too low to be measured by a method prescribed by JIS (Japanese Industrial Standards) or similar standards.

Figure 8A:
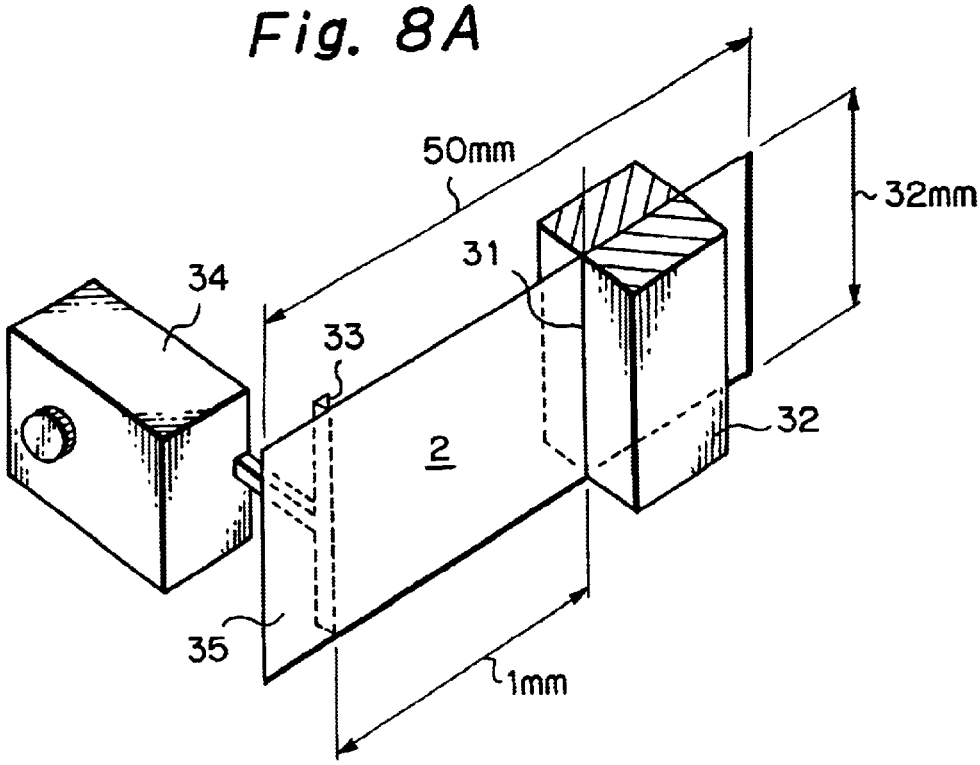
FIGS. 8A and 8B are respectively a perspective view and a plan view showing the generation configuration of a tester for measuring the rigidity of a stencil.
Figure 8B:
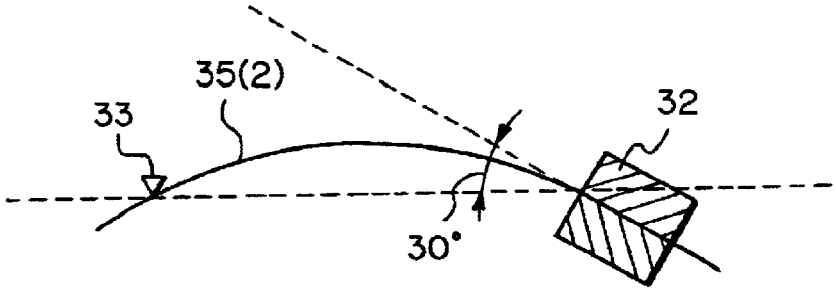

Specifically, as shown in FIGS. 8A and 8B, the L & W rigidity tester includes a damper 32 and a knife edge 33. The stencil 2 is implemented as a rectangular sample 35 sized 50 mm×32 mm. After the master 2 has its lengthwise direction positioned horizontally, one end of the master 2 is clamped by the damper 32 while the other end of the master 2 has its film surface held in contact with the knife edge 33. Then, the clamper 32 is turned by 30 degrees about a pivot shaft or vertical axis of rotation 31, causing the sample 35 (stencil 2) to bend. A force derived from the bending of the sample 35 is received by the knife edge 33 and then transformed for measurement by a transducer 34 including a screw for adjusting the position of the knife edge 33. As for the other conditions for measurement, the measurement span was 1.0 mm, and the bending rate was 5 degrees per second. In FIG. 8A, the measurement span is shown in an exaggerated scale for easy understanding.

Vertical rigidity and horizontal rigidity were measured with each of the conventional stencil 2 and synthetic fiber base stencil 2 by the L & W rigidity tester, as follows. Specifically, assume that the sample of the conventional master 2 or the sample of the synthetic fiber base master 2 is positioned horizontally in the direction of stencil conveyance Y. Then, the vertical rigidity and horizontal rigidity mentioned above respectively refer to bending rigidity in the direction Y and bending rigidity in the widthwise direction X of the sample. The conventional master 2 was made up of a base containing 60% of flax and a 1.5 $\mu$m thick PET thermoplastic resin film and had a total thickness of 43 $\mu$m to 47 $\mu$m. The measurement showed that the conventional stencil 2 had a vertical rigidity of about 128 mN (millinewtons) and a horizontal rigidity of about 70 mN, and that the synthetic fiber base stencil 2 had a vertical rigidity of about 35 mN and a horizontal rigidity of about 22 mN.

The thermal head 3 extends in parallel with the shaft 6*a* of the platen roller 6 and is movable into and out of contact with the platen roller 6 via the stencil 2 by being driven by moving means, not shown, including a spring, a cam and so forth. In the illustrative embodiment, the head 3 exerts a pressure of 103 N (linear pressure of 3.23 N/cm) on the platen roller 6.

Figure 5:
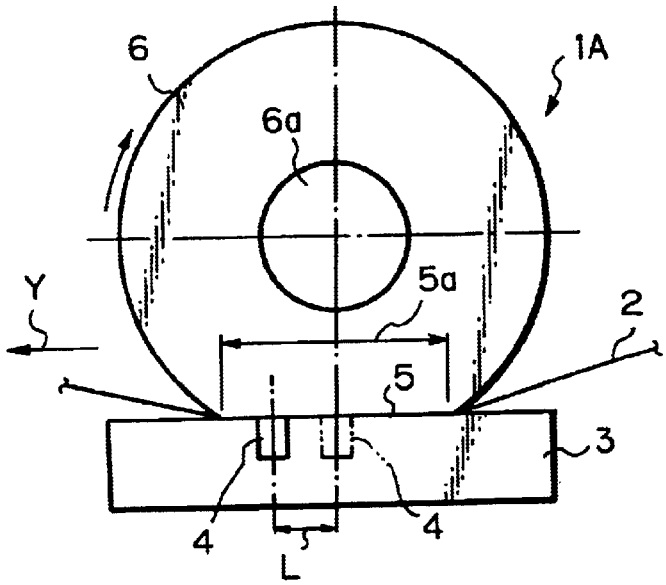
FIG. 5 is a front view showing a preferred embodiment of the master making device in accordance with the present invention, particularly a relation between a heating element array included in a thermal head and a platen roller.
Figure 6:
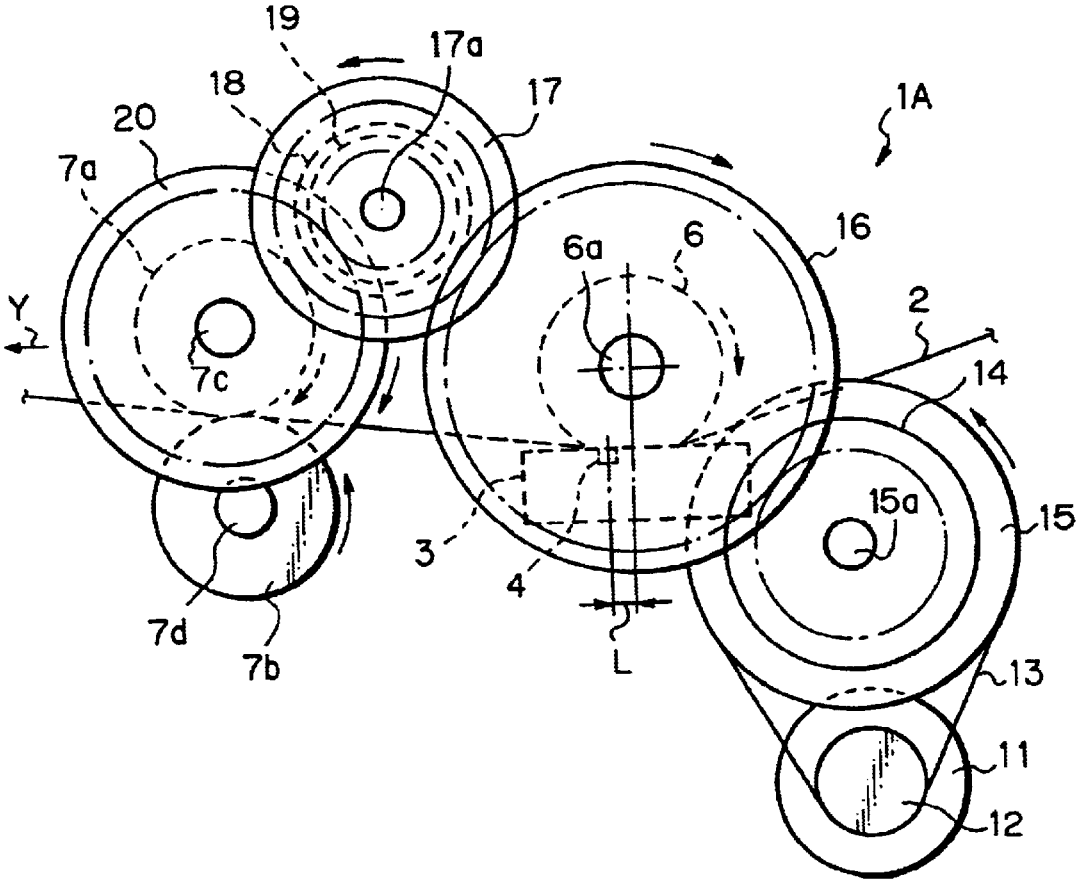
FIG. 6 is a front view showing a rotation transmission mechanism included in the illustrative embodiment.

As shown in FIGS. 5 and 6, the platen roller 6 is molded integrally with the shaft 6*a* with the intermediary of a metallic core not shown. Opposite ends of the shaft 6*a* are respectively rotatably supported by a pair of side walls positioned at the front and rear in the direction perpendicular to the sheet surface of FIGS. 5 and 6, so that the platen roller 6 is rotatable clockwise, as indicated by an arrow. A platen roller gear 16 is affixed to the front end portion of the shaft 6*a* with respect to the above direction. In the illustrative embodiment, the metallic core of the platen roller 6 has its outer periphery covered with a silicone rubber layer which does not adhere to the stencil 2 and is desirable in heat resistivity, conductivity and compression set. The platen roller 6 has an outside diameter of 24 mm and a rubber hardness of 43 Hs (JIS-A scale) and forms a nip width 5*a* of 2.5 mm to 3.0 mm when compressed by the head 2.

The drive motor 11 is mounted on the front side wall adjoining the platen roller 6. A toothed motor pulley 12 is mounted on the output shaft, not shown, of the drive motor 11. A toothed drive pulley 15 is positioned in the vicinity of the platen roller 6 and mounted on a shaft 15*a* journalled to the front side wall. A timing belt 13 is passed over the motor pulley 12 and drive pulley 15. A drive gear 14 is interposed between the motor 11 and the platen roller 6. The drive gear 14 is mounted on the same shaft 15*a* as the drive pulley 15 and held in mesh with a platen roller gear 16.

As shown in FIG. 6, the upper tension roller 7*a* constitutes a drive roller molded integrally with a shaft 7*c*. The shaft 7*c* is rotatably supported by the above opposite side walls, so that the tension roller 7*a* is rotatable clockwise, as indicated by an arrow. The lower tension roller 7*b* constitutes a driven roller molded integrally with a shaft 7*d*. The shaft 7*d* is also rotatably supported by the side walls and allows the tension roller 7*b* to rotate counterclockwise, as indicated by an arrow. The tension rollers 7*a* and 7*b* are pressed against each other by an adequate force implemented by a spring or similar biasing means, causing tension to act in the portion of the stencil 2 downstream of the platen roller 6 in the direction Y. In the illustrative embodiment, the tension rollers 7*a* and 7*b* each is covered with a silicone rubber layer and has an outside diameter of 18 mm and a rubber hardness of 33 Hs (JIS-A scale). A pressure of 20 N acts between the tension rollers 7*a* and 7*b*.

A larger diameter idle gear 17, a smaller diameter idle gear 19 and a torque limiter 18 are positioned between the platen roller 6 and the tension roller 7*a*. The larger diameter idle gear 17 is mounted on a shaft 17*a* journalled to the front side wall and is held in mesh with the platen roller gear 16. The smaller diameter idle gear 19 is coaxial with the gear 17 and held in mesh with a tension roller gear 20. The torque limiter 18 is positioned between the two idle gears 17 and 19. In the illustrative embodiment, the torque limiter 18 is of friction type and implements a torque of 1 kgf·cm (nearly equal to 0.1 N·m). The friction type torque limiter may, of course, be replaced with a magnet type torque limiter using a magnet and a magnetic body or a powder type torque limiter using an electromagnet and magnetic powder.

The rotation of the drive motor 11 is transferred to the platen roller 6 via the motor pulley 12, timing belt 13, drive pulley 15, drive gear 14, and platen roller gear 16. At the same time, the rotation of the drive motor 11 is transferred to the tension roller gear 20 via the platen roller gear 16, idle gear 17, torque limiter 18, and idle gear 19. In the illustrative embodiment, assuming that the peripheral speed of the platen roller 6 is 1, then the tension rollers 7*a* and 7*b* rotate at a peripheral speed of 1.4 in cooperation with the torque limiter 18. As a result, the portion of the stencil 2 perforated by the array of the heating elements 4 is subjected to a front tension of 0.1 N·m between the platen roller 6 and the tension rollers 7*a* and 7*b*.

The operation of the above embodiment will be described hereinafter, concentrating mainly on the differences between the embodiment and the master making device 1 of FIG. 4. In the master making step, the drive motor 11 is energized in order to cause the above rotation transmission mechanism to operate. Specifically, the platen roller 6 pressing the stencil 2 against the head 3 and the tension rollers 7*a* and 7*b* start rotating, so that the stencil 2 is paid out from the roll 2A and conveyed to the downstream side in the direction Y. As shown in FIG. 5, the heating elements 4 of the head 3 are selectively energized in accordance with the digital image signal received from the AD conversion board, not shown. The energized heating elements 4 perforate the portions of the thermoplastic resin film of the stencil 2 contacting them.

The tension rollers 7*a* and 7*b* rotate, in cooperation with the torque limiter 18, at the peripheral speed (=1.4) higher than the peripheral speed (=1) of the platen roller 6, as stated earlier. Consequently, the portion of the stencil 2 perforated by the heating elements 4 is subjected to the front tension of 0.1 N·m between the platen roller 6 and the tension rollers 7*a* and 7*b*. In this condition, the stencil or master 2 is conveyed to the downstream side in the direction Y by the tension rollers 7*a* and 7*b*.

The reproducibility of image dimensions, creasing ascribable to master making and local omission of an image were repeatedly determined with the master making device 1A by shifting the center of the array of the heating elements 104 little by little away from the position where it is coincident with the center of the platen roller 6 (deviation L=0) to the downstream side in the direction Y within the nip 5. FIG. 9 lists the results of such an experiment. The experiment was conducted with the various specific specifications of the relating parts and various mechanical conditions stated above.

Figure 10:
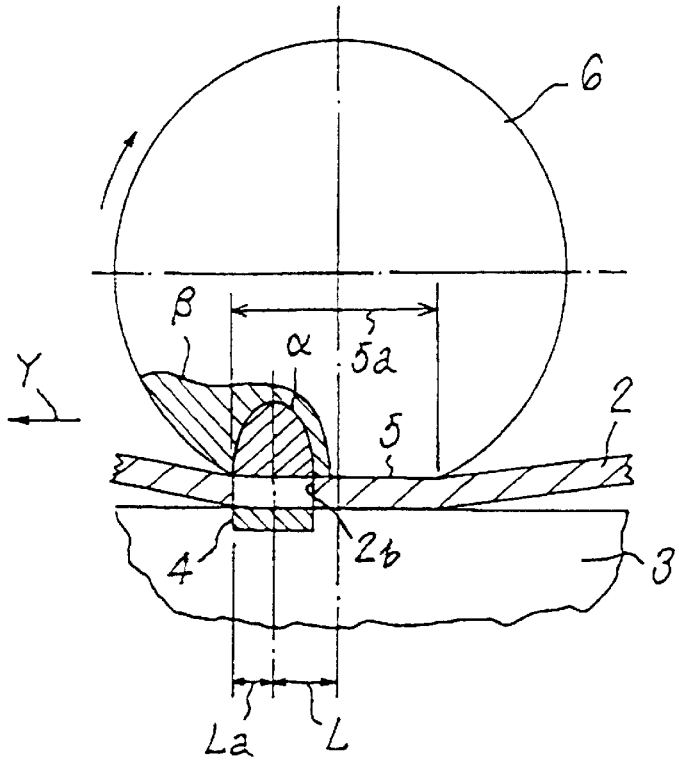
FIG. 10 is a partly sectional front view showing a condition wherein the heating element array is shifted to the most downstream position within a nip in the direction of stencil feed.

In FIG. 9, double circles, circles, and crosses are respectively representative of desirable results, acceptable or practical results and unacceptable or impractical results as to image dimension reproducibility, creasing, and local image omission. As FIG. 9 indicates, the deviation L of the heating elements 4 should preferably lie in the range of from 0.2 mm to 0.8 mm. As shown in FIG. 10, in this range of deviations L, the conveying length (or conveying time) of the perforated portion of the synthetic fiber base stencil 2 in the nip 5 was reduced. As a result, the influence of sticking was successfully reduced. This, coupled with perforation free from creases and local omission of an image, provided the resulting master 2 with an accurate length. Specifically, when the conveying length La(=(5*a*/2)−L) is relatively short within the range shown in FIG. 9, the synthetic fiber base stencil 2 is scarcely influenced by the distribution of heat $\beta$ previously stored in the platen roller 6, the current heat distribution $\alpha$ ascribable to perforation, and heat stored in the heating elements 4. As a result, there occurs little difference between the perforated portion and the non-perforation portion of the stencil 2 as to the conveying force. This allows a minimum of creasing to occur and insures desirable image dimension reproducibility. Even when the stencil 2 is perforated over its entire width, the conveying force decreases little and insures desirable stencil conveyance and image dimension reproducibility.

Moreover, in the above desirable range of deviations L, the tension roller 7*a* applying tension to the synthetic fiber base stencil 2 between the platen roller 6 and the tension roller pairs 7*a* and 7*b* reduces a load acting on the platen roller 6 due to sticking and thereby prevents the resulting master 2 from decreasing in length. The load acting on the platen roller 6 is further reduced by the torque limiter 18, FIG. 6, implementing constant tension. Consequently, the platen roller 6 and stencil 2 are prevented from slipping on each other. This corrects a change in the master making length of the stencil 2 ascribable to a change in the above tension and thereby insures stable and accurate master conveyance.

Figure 11:
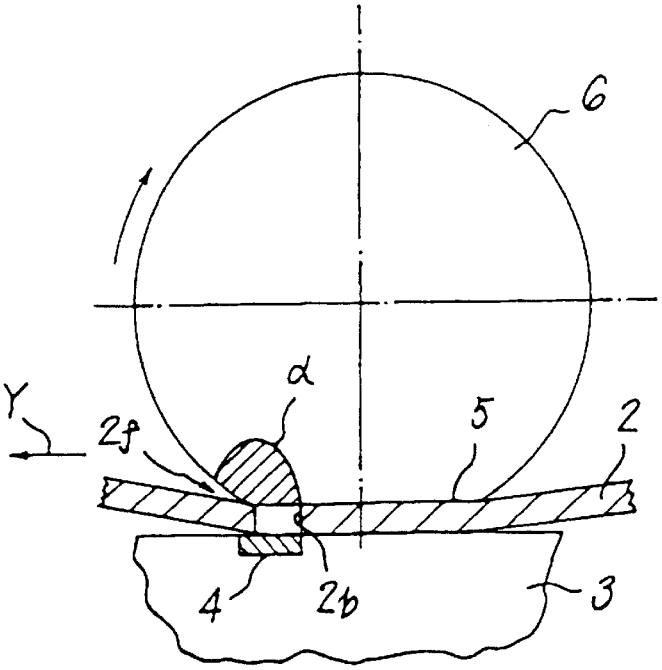
FIG. 11 is a view similar to FIG. 10, showing a condition wherein the heating element array is shifted to the downstream side out of the nip in the direction of stencil feed.

When the deviation L of the heating elements 4 is 0 mm, the phenomenon discussed earlier with reference to FIGS. 2 and 3 presumably occurs. As shown in FIG. 11, when the deviation L is greater than 1.0 mm, it is likely that the heating elements 4 are brought out of the nip 5 due to scatters in the accuracy of the relating parts. This would bring about local omission 2*f* of the image although minimizing a difference and a decrease in conveying force and insuring stable conveyance.

While the above experiment was conducted with the synthetic fiber base stencil 2, it was experimentally proved that results comparable with the results shown and described are achievable even with the conventional stencil or a stencil substantially consisting only of a thermoplastic synthetic resin film. The stencil substantially consisting only of a thermoplastic synthetic resin film refers not only to a stencil consisting only of a thermoplastic resin film, but also to a stencil whose thermoplastic resin film contains, e.g., a trace of an antistatic agent and a stencil having one or more overcoat layers or similar thin film layers on one or both of opposite major surfaces of its thermoplastic resin film.

If the above advantages of the illustrative embodiment are not of primary importance, then the torque limiter 18 of the rotation transmission mechanism may be omitted. In such a case, the gear ratio, for example of the rotation transmission mechanism will be suitably varied in order to allow the tension rollers 7*a* and 7*b* to rotate at a slightly higher peripheral speed than the platen roller 6, thereby applying substantially constant tension to the stencil 2 between the tension rollers 7*a* and 7*b* and the platen roller 6.

In the illustrative embodiment, the drive means for rotating the tension rollers 7*a* and 7*b* is implemented by the drive motor 11 assigned to the platen roller 6. Alternatively, the tension rollers 7*a* and 7*b* may be driven by, e.g., a stepping motor independent of the drive motor 11.

If the conveyance of the stencil 2 does not have to be improved so much, the drive motor 11 assigned to the platen roller 6 may be omitted, in which case the tension rollers 7*a* and 7*b* will be rotated by an exclusive drive motor or tension roller drive means. In such a configuration, the rotation of the tension rollers 7*a* and 7*b* will cause the platen roller 6 to follow it via the stencil 2, thereby moving the stencil 2 to the downstream side in the direction Y.

In summary, it will be seen that the present invention provides a master making device for a stencil printer having various unprecedented advantages, as enumerated below.

(1) A master can be formed under a minimum of influence of sticking and without any crease or local omission of an image without regard to the kind of a stencil. The master therefore achieves desirable image reproducibility and accurate length and can be conveyed in a stable manner.

(2) Because tension is applied to the stencil between a platen roller and tension rollers, a load acting on the platen roller due to sticking is reduced to prevent the length of the resulting master from decreasing.

(3) The load acting on the platen roller is further reduced by a torque limiter implementing constant tension. Consequently, the platen roller and stencil are prevented from slipping on each other. This corrects a change in the master making length of the stencil ascribable to a change in the above tension and thereby insures stable and accurate master conveyance.

Various modifications will become possible for those skilled in the art after receiving the teachings of the present disclosure without departing from the scope thereof.

What is claimed is:

1. A master making device, comprising:

a thermal head including a plurality of heating elements arranged in an array in a main scanning direction; and a platen roller forming a nip between said platen roller and said thermal head and adapted for pressing a stencil, said platen roller being rotatable and adapted for moving a stencil in a subscanning direction perpendicular to the main scanning direction;

wherein a position of said array in the subscanning direction is downstream by greater than 0.3 mm to 0.8 mm from a center of said platen roller in the subscanning direction and wherein said array is located entirely in a perpendicular projection of an area formed by said nip to thereby reduce a length of a perforated portion of the stencil to be moved in said nip.

2. A master making device as claimed in claim 1, further comprising a tension roller located downstream of said platen roller in the subscanning direction for applying tension to a portion of the stencil located downstream of the subscanning direction.

3. A master making device as claimed in claim 2, further comprising:

platen roller drive means for driving said platen roller;

tension roller drive means for driving said tension roller; and a torque limiter interposed between said tension roller and said tension roller drive means for causing said tension roller to rotate at a higher peripheral speed than said platen roller.

4. The master making device as claimed in claim 1, wherein said platen roller is adapted for pressing and moving a stencil comprising one of a synthetic fiber base stencil or a stencil substantially consisting only of a thermoplastic resin film.

5. A master making device, comprising:

a thermal head including a plurality of heating elements arranged in an array in a main scanning direction; and a platen roller forming a nip between said platen roller and said thermal head and adapted for pressing one of a synthetic fiber base stencil or a stencil substantially consisting only of a thermoplastic resin film, said platen roller being rotatable and adapted for moving one of a synthetic fiber base stencil or a stencil substantially consisting only of a thermoplastic resin film in a subscanning direction perpendicular to the main scanning direction;

wherein a position of said array in the subscanning direction is downstream by greater than 0.3 mm to 0.8 mm from a center of said platen roller in the subscanning direction and wherein said array is located entirely in a perpendicular projection of an area formed by said nip to thereby reduce a length of a perforated portion of the stencil to be moved in said nip.

6. A master making device as claimed in claim 5, further comprising a tension roller located downstream of said platen roller in the subscanning direction for applying tension to a portion of the stencil located downstream of the subscanning direction.

7. A master making device as claimed in claim 6, further comprising:

platen roller drive means for driving said platen roller;

tension roller drive means for driving said tension roller; and a torque limiter interposed between said tension roller and said tension roller drive means for causing said tension roller to rotate at a higher peripheral speed than said platen roller.

* * * * *

UNITED STATES PATENT AND TRADEMARK OFFICE

CERTIFICATE OF CORRECTION

PATENT NO. : 6,626,098 B1
DATED : September 30, 2003
INVENTOR(S) : Yoshio Kanamori It is certified that error appears in the above-identified patent and that said Letters Patent is hereby corrected as shown below:

Column 6,
Line 33, please change “damper” to -- clamper -- (first and second occurrences);
Line 38, change “damper” to -- clamper --.

Column 7,
Line 67, please change “damper” to -- clamper --.

Column 8,
Line 4, please change “damper” to -- clamper --.

Column 10,
Line 2, change “104” to -- 4 --.

Signed and Sealed this

Twenty-second Day of June, 2004

JON W. DUDAS
*Acting Director of the United States Patent and Trademark Office*